United States Patent [19]

Besson et al.

[11] 4,281,405

[45] Jul. 28, 1981

[54] REDUCTION OF ENERGY CONSUMPTION OF ELECTRONIC TIMEPIECE

[75] Inventors: René Besson, Neuchatel; Igor Scherrer, Colombier, both of Switzerland

[73] Assignee: Ebauches S.A., Switzerland

[21] Appl. No.: 50,340

[22] Filed: Jun. 20, 1979

[30] Foreign Application Priority Data

Jun. 20, 1978 [CH] Switzerland ..... 6715/78

[51] Int. Cl.³ ..... G04B 9/00

[52] U.S. Cl. ..... 368/66; 368/76; 368/80; 368/85; 368/86

[58] Field of Search ..... 318/685, 696; 307/270; 363/74; 58/23 R, 23 D, 23 BA, 4 A, 58, 125 R, 126 R; 368/66, 76, 80, 85–87

[56] References Cited

U.S. PATENT DOCUMENTS

| | | | |
|---|---|---|---|
| 3,812,670 | 5/1974 | Nikaido et al. | 58/23 R |
| 3,855,781 | 12/1974 | Chihara et al. | 58/23 D X |
| 3,958,182 | 5/1976 | Sauthier | 318/696 X |
| 3,963,946 | 6/1976 | Zajac | 318/696 X |
| 3,992,868 | 11/1976 | Tamaru et al. | 58/23 BA X |
| 4,031,447 | 6/1977 | Togo et al. | 318/696 X |
| 4,032,827 | 6/1977 | Dobratz et al. | 318/696 |

FOREIGN PATENT DOCUMENTS

| | | |
|---|---|---|
| 2125224 | 11/1972 | Fed. Rep. of Germany . |
| 2745052 | 4/1978 | Fed. Rep. of Germany . |
| 2200675 | 4/1974 | France . |

*Primary Examiner*—Ulysses Weldon

*Attorney, Agent, or Firm*—Allegretti, Newitt, Witcoff & McAndrews

[57] ABSTRACT

Reduces the consumption of an electronic time piece equipped with a motor 4 driving a display unit 5. A quartz oscillator 1 feeds a supply circuit 3 through a frequency divider 2. The supply circuit 3 of the motor and its control circuit 9 periodically decrease the pulse energy supplied to the motor in response to a reference signal 8.2 provided by a reference counter say every 60 seconds. The energy then supplied to the motor is regulated as a function of the presence or absence of a signal delivered by a detection switch 7 operated by the display unit. If the detection switch does not close, compensating pulses are fed to the motor to catch up the lost seconds and the pulse energy is stepped up.

10 Claims, 16 Drawing Figures

FIG. 1
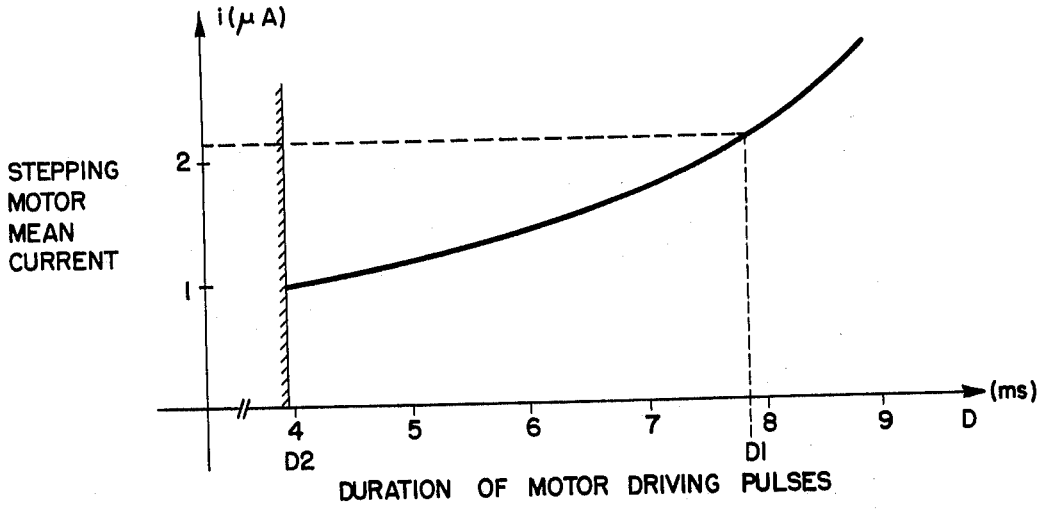
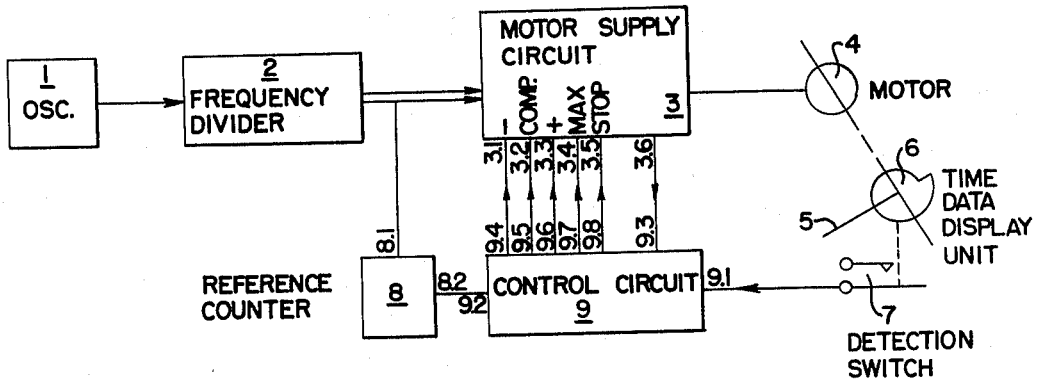
FIG. 2

D
N
D7 D6 D5 D4 D3 D2 D1 D0
N7 N6 N5 N4 N3 N2 N1 N0
Nr
a
59 58 57 56 55 28 27 26 2 1 0
7 8.2 9.4 9.5 3.6 9.6
t
0 1 2 59 0 1 59 0 1 59 0 1 59 0 1 2
26 27 28 29 30 31 59 0 1 2

FIG. 8
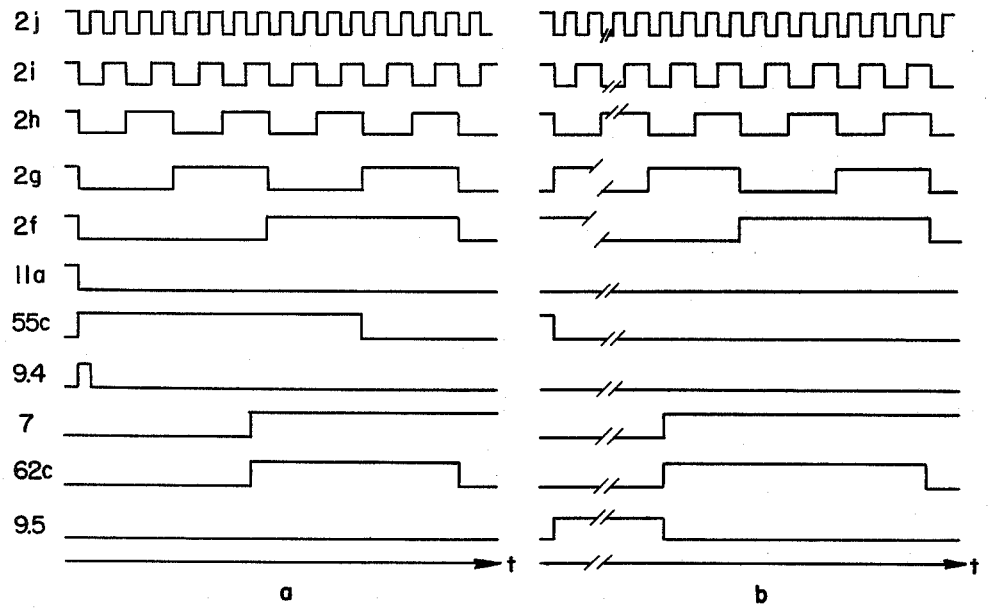
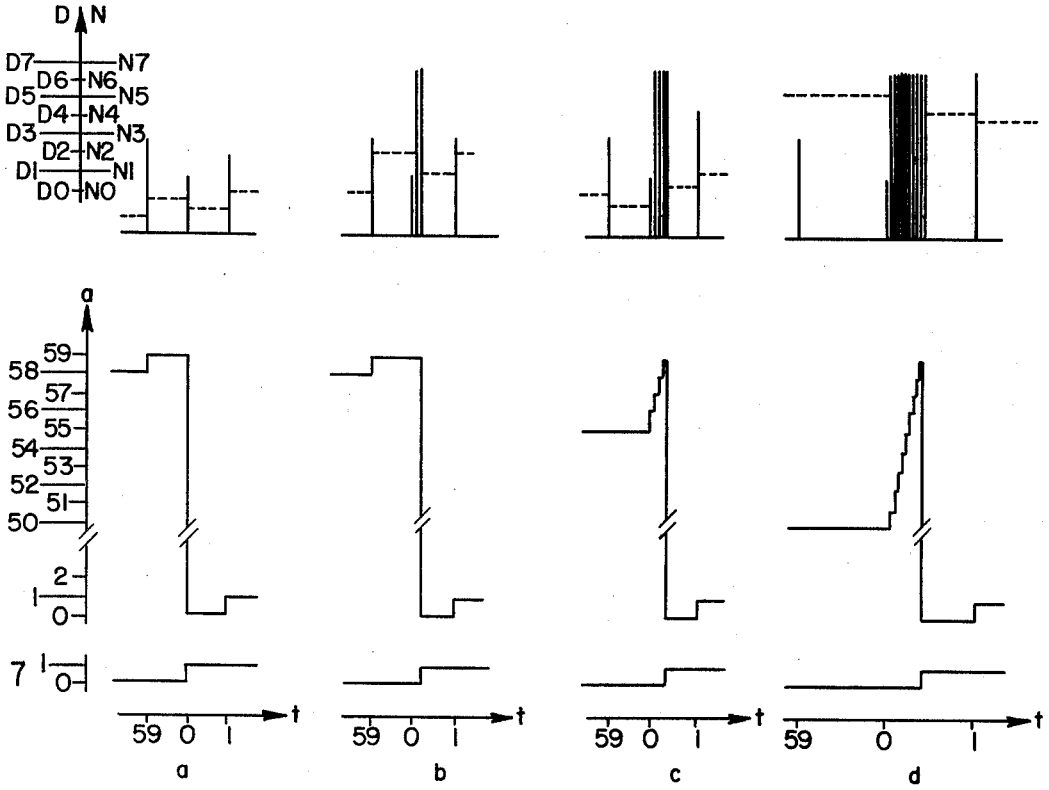
FIG. 9

FIG. 11
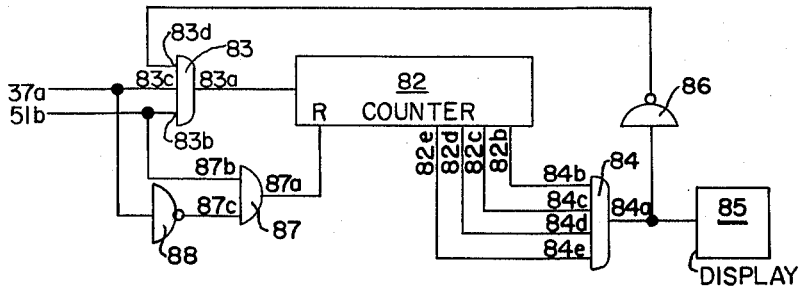
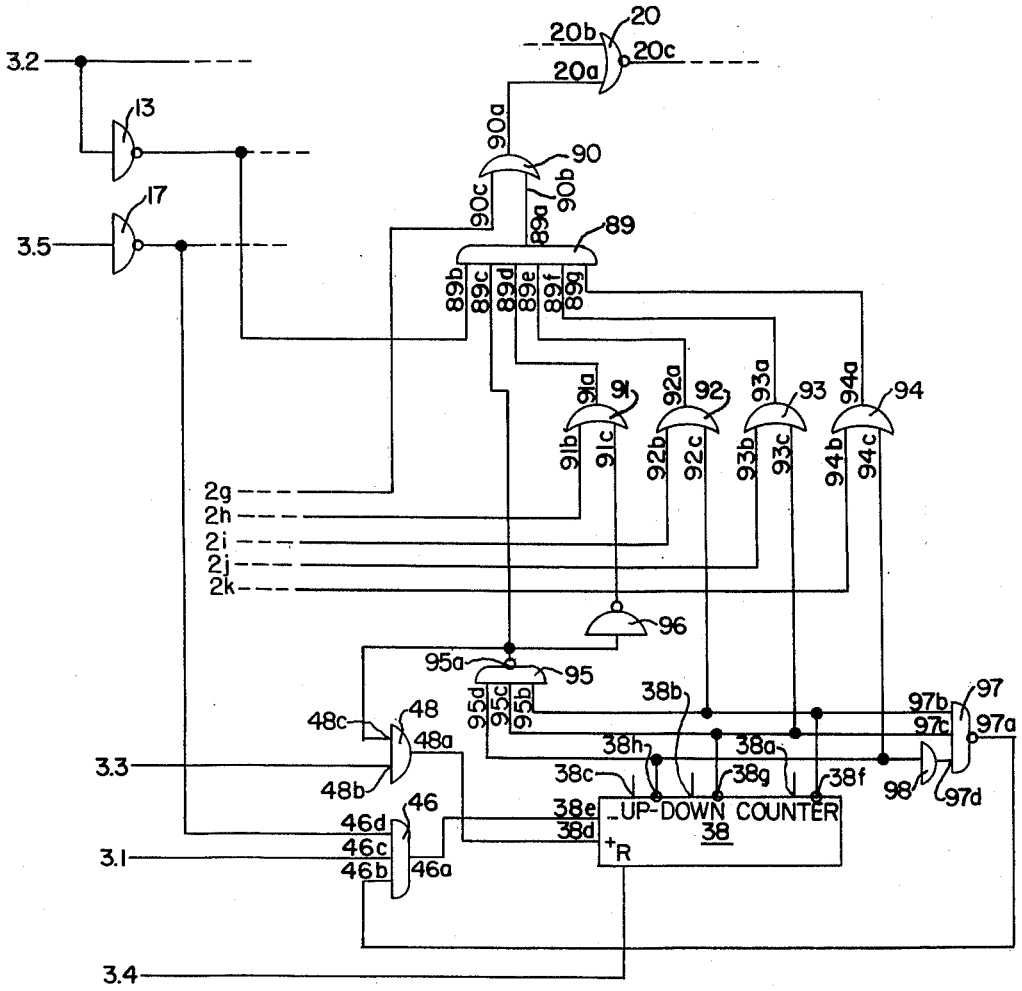
FIG. 12

REDUCTION OF ENERGY CONSUMPTION OF ELECTRONIC TIMEPIECE

BACKGROUND OF THE INVENTION

The present invention concerns a method of reducing the consumption of electrical energy of an electronic time piece in which a motor supplied with electrical energy supplies mechanical energy to drive a time data display unit. The invention also concerns an electronic time piece in which the method is used and comprising a motor driving a time data display unit, an oscillator used as time base, a frequency divider coupled to the oscillator, and a supply circuit coupled to the divider and delivering electrical energy to the motor.

In a time piece of the above type, the greatest part of the energy supplied by the electrical supply source, which is generally a battery, is consumed by the motor. The mean current absorbed by the latter is in fact of the order of two microamperes while the other electronic circuits of the watch (oscillator, divider, etc.) combined in an integrated circuit together consume less than 0.5 microamperes. It is therefore important to limit the motor's consumption as much as possible to increase the life of the battery or to be able to make the volume of this battery smaller, for a given life.

The motor receives driving pulses from a shaper circuit supplied with low frequency signals by a frequency divider connected to a quartz oscillator which forms the time base of the watch. In known watches the shaper circuit is adjusted so as to supply sufficient power to make the motor function in the worst conditions that may possibly occur: low battery voltage, driving of the calendar mechanism, clogging or irregularity of the gears, shocks, etc. As these bad conditions are only rarely encountered, the power supplied to the motor is most of the time far greater than that necessary for making it function reliably. There is therefore a waste of energy involved.

The object of the present invention is to avoid this waste.

BRIEF SUMMARY OF THE INVENTION

According to the present invention in one aspect there is provided a method of reducing the consumption of electrical energy in an electronic time piece in which a motor supplied with electrical energy supplies the mechanical energy to drive a time data display unit, comprising the steps of detecting, at least periodically, a possible error in position of the display unit, and effecting consequent adjustment of the electrical power corresponding to the minimum mechanical power required for the said error to stay at or return to virtually zero.

According to the present invention, in another aspect there is provided an electronic time piece comprising a motor driving a time data display unit, an oscillator used as time base, a frequency divider coupled to the oscillator, a supply circuit coupled to the divider and delivering electrical energy to the motor, and control means for the supply circuit arranged to detect, at least periodically, a possible error in position of the display unit, and to adjust the electrical power to that corresponding to the minimum mechanical power required for the said error to be zero.

BRIEF DESCRIPTION OF THE DRAWINGS

The invention will be described in more detail, by way of example, with reference to the accompanying drawings, in which:

FIG. 1 is a diagram of the mean current consumed by a stepping motor as a function of the duration of the driving pulses.

FIG. 2 is a block diagram of a first illustrative embodiment of a watch according to the invention.

FIGS. 6 to 8 are diagrams assisting understanding of the functioning of the circuits in FIGS. 4 and 5.

FIG. 9 illustrates the functioning of a second illustrative embodiment of a watch according to the invention.

FIG. 11 is a diagram of an indicator circuit which can be used with either of the circuits of the two embodiments, and FIG. 12 is the diagram of a variant of the circuit in FIG. 4.

DETAILED DESCRIPTION OF THE PREFERRED EMBODIMENTS

Figures 3A, 3B, 3C:
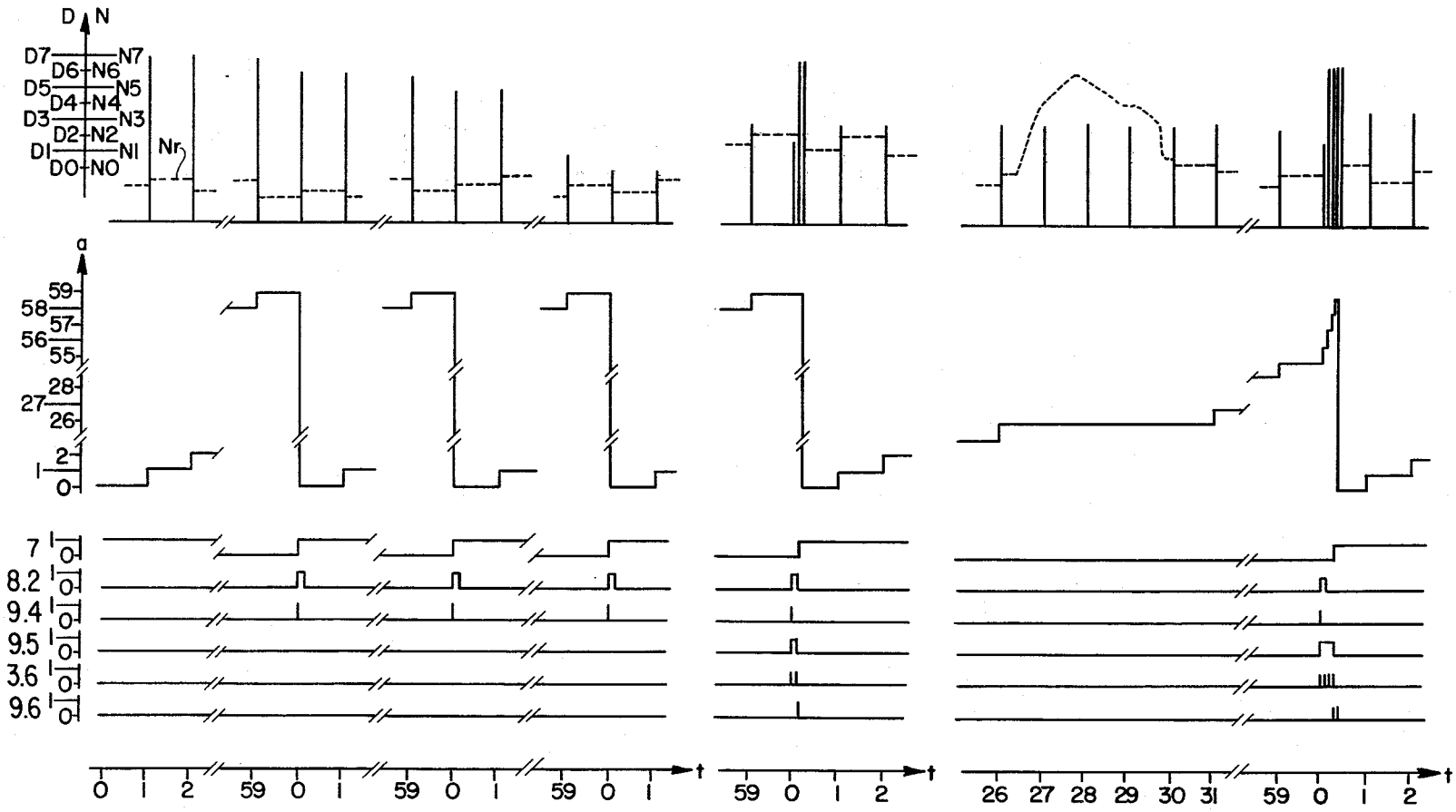
FIGS. 3*a* to 3*e* illustrate various instances of functioning of this first embodiment.

The electrical energy supplied to the stepping motor of a watch during a driving pulse is, as is known, determined by the product of the voltage applied to the motor, of the current which passes through it and of the duration of this pulse. To reduce this energy for a given motor, the voltage applied to the motor or the duration of the pulse can therefore be acted upon.

In the first and second illustrative embodiments of the watch according to the invention, which will be described in detail hereinafter, the variation in the energy supplied by the driving pulses is obtained by varying the duration of the latter.

FIG. 1 illustrates, by way of example, the variation in the mean current absorbed by a typical stepping motor as a function of the duration of the driving pulses which are applied to it. It can be seen here that, for a duration $D_1$ of 7.8 milliseconds, a duration which is currently used in present-day watches, this mean current is about twice as high as with a duration $D_2$ of 4 milliseconds, which is the minimum duration for which the motor continues to function.

FIG. 2 is a block diagram of a watch according to the invention, which comprises a quartz oscillator 1 delivering a high frequency signal, for example, 32 kHz, to a frequency divider 2.

The divider 2, which is constituted, in a conventional way, by a series of flip-flops connected in cascade, supplies to a shaper circuit 3, or supply circuit, low frequency signals that the latter uses to develop the driving pulses which it delivers to the motor 4. These driving pulses are generally alternated, that is to say, their polarity is always the opposite of that of the pulse which precedes them and of that which follows them.

This pulse shaper, a detailed diagram of which will be described later, is arranged so as to be able to regulate, by step, the duration of the driving pulses, between a maximum duration $D_{max}$ and a minimum duration $D_{min}$, in response to the signals it receives at its control inputs 3.1 to 3.5. More precisely, a signal at the input 3.1 causes the decrease by one step of the duration of the driving pulse, as long as the minimum value $D_{min}$ has not already been reached. A signal at its input 3.2 causes the formation of driving pulses of maximum duration and relatively high frequency, 64 Hz, for example. These pulses, called compensation pulses, are used, in a way which will be described later, to compensate for a delay shown by the seconds pointer. The input 3.3 is intended to receive pulses, each causing an increase by one step in the duration of the driving pulses, if the latter do not already have the maximum duration. The input 3.4 is intended to receive a pulse causing the return of the pulse duration to maximum value. Finally, a signal at the input 3.5 causes, for the length of its duration, the complete halt of the driving pulses. In addition, the shaper 3 is provided with an output 3.6 which delivers a pulse for each compensation pulse delivered to the motor.

The motor 4 drives, by a mechanism which is well known but not represented in FIG. 2, a time data display unit comprising a seconds pointer 5 as well as minutes and hours pointers and, if need be, a calendar or other mechanism (also not represented). These pointers move in front of a dial generally provided with graduations. The graduation corresponding to the seconds pointer in particular is numbered, explicitly or implicitly, from 0 to 59.

The seconds pointer 5 is connected to a cam 6 which closes a contact 7 when the pointer 5 arrives at a reference position such as the graduation 0 of the dial (noon). This cam 6 has such a shape that the contact stays closed until the pointer 5 is approximately facing the graduation 15 of the dial.

A reference counter 8, hereinafter called "counter-tracker 8", with a counting capacity of 60, receives at its input 8.1, pulses at a frequency of 1 Hz from the divider 2. Its state consequently varies cyclically from 0 to 59. It will be seen later that this state corresponds, at least in normal time, to the position of the pointer 5 on the dial, hence the term "counter-tracker". This counter-tracket 8 is provided with an output 8.2 delivering a reference signal when it changes from its state 59 to its state 0. By comparing this reference signal with that delivered by the contact 7 when it is closed, a possible error in position of the pointer 5 can consequently be indicated by suitable control means which will be described later.

A control circuit 9 includes an input 9.1 connected to the contact 7, which is arranged so as to deliver to this input 9.1 a detection signal with the logic state "1" when it is closed and the logic state "0" when it is open. The control circuit 9 is also provided with an input 9.2 connected to the input 8.2 of the counter-tracker 8, with an input 9.3 connected to the output 3.6 of the shaper 3 and with five outputs 9.4 to 9.8 respectively connected to the inputs 3.1 to 3.5 of the shaper 3 and delivering the various control signals which have been mentioned above in the following way:

the output 9.4 delivers a pulse each time the counter-tracker 8 delivers its signal 8.2 (with one exception which will be described later).

the output 9.5 delivers a signal controlling the sending of compensation pulses by the shaper 3 when the contact 7 is not closed under the action of the test pulse.

the output 9.6 delivers a certain number of pulses if a compensation has had to be made (in the example described later, this number is 1 if one or two compensation pulses have had to be sent, or 2 if more than two compensation pulses have been necessary for the contact 7 to be closed).

the output 9.7 delivers a signal if more than seven compensation pulses have had to be delivered before the contact 7 is closed, and the output 9.8 delivers a signal if the contact 7 is closed before the counter-tracker 8 delivers its signal 8.2.

FIGS. 3*a* to 3*e* illustrate five different instances of the functioning of the watch of FIG. 2. In each of these figures, the time is the abscissa and its axis is graduated in seconds. The numbers indicated correspond at each instant to the state of the counter-tracker 8. Please note that the time scale is twice as great in FIG. 3*d* as in FIGS. 3*a*, 3*b*, 3*c* and 3*e*.

In each of these figures, the various diagrams represent, from top to bottom:

driving pulses by vertical segments whose length corresponds to the duration D of these driving pulses, a duration which can vary in steps, in this example, from a maximum duration $D_7$ to a minimum duration $D_0$. On the same axis has been placed the motor torque N which depends directly on the duration D, and which consequently varies in steps between a maximum value $N_7$ and a minimum value $N_0$. In this diagram the resisting torque $N_r$ has also been indicated by horizontal broken lines. This resisting torque is normally constant between two driving pulses, as the motor and the mechanism are stopped, but it can vary during driving pulses, for various reasons. It can sometimes change between driving pulses, as a result of shocks for example.

the position $\alpha$ of the seconds pointer marked by the number of the division in front of which it stops between two driving pulses.

the state of the contact 7, "0" and "1" corresponding respectively to the open and closed states.

the state of various signals designated by the reference of the point in the block diagram of FIG. 2 where they are measured, "0" and "1" then corresponding to their logic states.

In the description which follows, these signals will also be designated by this reference.

In the case illustrated in FIG. 3*a*, it will be assumed that the battery is put in the watch at time 0, (which starts the watch), and that the resistance torque is small. After one second, the motor begins to receive driving pulses with a period of 1 second and maximum duration $D_7$ which advance the motor as, in this instance, the resistance torque is smaller than the motor torque. When the counter-tracker 8, which also receives at its input 8.1 1 Hz frequency pulses, reaches its state 8, it delivers at its output 8.2 a signal which causes the decreasing by one step of the duration of the next driving pulse which will consequently have a duration $D_6$. As the latter is sufficient to advance the motor, which is marked by the closure of the contact 7 before the end of the pulse 8.2, the control circuit 9 does not react, and the shaper 3 continues to produce driving pulses of duration $D_6$.

When, after 60 seconds, the counter-tracker 8 again delivers its signal 8.2, the shaper 3 again decreases by one step the duration of the driving pulses, which changes to $D_5$, and so forth, until, after seven minutes, this duration changes to $D_0$, which is the minimum duration. If the resistance torque does not exceed the value corresponding to this duration, the shaper 3 continues to deliver driving pulses with this minimum duration $D_0$.

FIG. 3*b* illustrates a situation in which the driving pulses first have a duration $D_3$. When the counter-tracker 8 reaches its state 0 and delivers the signal 8.2, the shaper 3 decreases the width of the driving pulses to the value $D_2$. But the resistance torque, for some reason, is larger at this instant than the motor torque $N_2$. Consequently the motor does not advance, and the contact 7 does not close. The control circuit 9 detects this state from the fact that, at the end of the signal 8.2, the signal 7 is not present. It then immediately sends a signal 9.5 to shaper 3, which begins to deliver compensation pulses of maximum duration $D_7$ and 64 Hz frequency as well as, for each compensation pulse, a pulse 3.6.

In the present instance, the second compensation pulse brings the seconds pointer 5 to its position 0 and the contact 7 closes. The first compensation pulse in fact has the same polarity as the driving pulse which has brought the motor 4 into position, and consequently has no influence on it. When the contact 7 closes, the control circuit 9 immediately cuts out the signal 9.5 and delivers a signal 9.6 which has the effect of increasing by one step the duration of the next driving pulses, which therefore changes again to $D_3$, and stays there for the subsequent 59 pulses, after which the process begins again.

It will be noted that, in FIG. 3*b* and FIGS. 3*c*, 3*d* and 3*e*, the distance between the compensation pulses has been exaggerated to facilitate reading of the drawing.

FIG. 3*c* illustrates an instance in which, because of a series of shocks, for example, the resistance torque assumes a value greater than the motor torque for about three seconds, while the pointer 5 is in position 27. The three driving pulses of duration $D_3$ delivered during these shocks consequently cannot advance the pointer 5 which takes 3 seconds delay. The first driving pulse which follows these shocks has the same polarity as that which has preceded them. Consequently it does not advance the motor and the pointer 5 takes a fourth second of delay. When the counter-tracker 8 delivers its signal 8.2, the duration of the driving pulses is reduced, as always, by one step and assumes the value $D_2$, which is sufficient to advance the motor. But, because of the delay incurred previously, the contact 7 does not close and, as in the previous instance, the control circuit 9 sends a signal 9.5 to the shaper 3. The latter begins to produce compensation pulses. On the fourth of these pulses, the seconds pointer reaches its position 0 and the contact 7 closes; the control circuit 9 then immediately cuts off the signal 9.5. As four compensation pulses have been delivered, that is to say, more than two and less than eight, the control circuit 9 delivers two pulses to its output 9.6, which makes the duration of the driving pulses change to $D_4$, that is to say, a duration greater by one step than the duration of the preceding pulses.

Figure 3D:
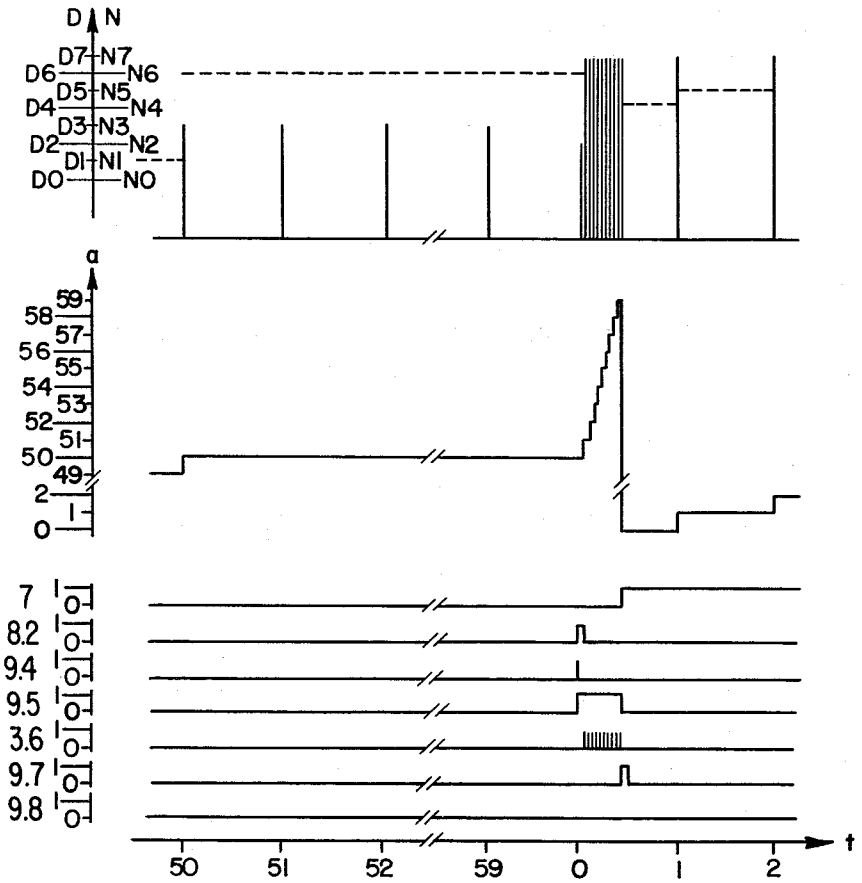

FIG. 3*d* illustrates an instance in which, from position 50 of the seconds pointer, the resistance torque assumes a larger value than that of the motor torque, owing to the start of the driving of the calendar mechanism, for example. The seconds pointer 5 consequently remains halted in this position 50 and, as in the preceding instances, at the end of the signal 8.2, the control circuit delivers the signal 9.5. The shaper 3 begins to supply compensation pulses to the motor which runs rapidly. On the 10th pulse, the pointer 5 reaches its position 0, the contact 7 closes and the signal 9.5 disappears. As more than eight compensation pulses have been necessary, the control circuit 9 sends the signal 9.7 to the shaper circuit 3 which delivers, from that instant on, driving pulses of maximum duration $D_7$. After 59 of these driving pulses, the process described in connection with FIG. 3*a* begins again.

Figure 3E:
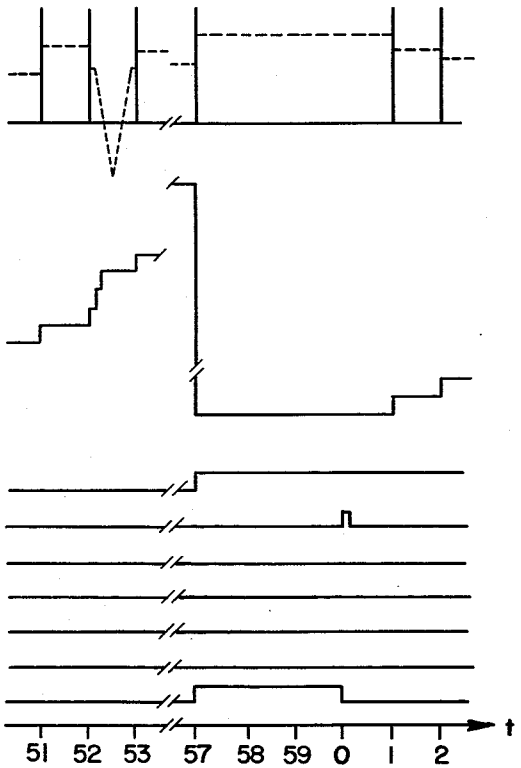

FIG. 3*e* illustrates an instance in which, again owing to a shock, for example, occurring when it is in position 52, the seconds pointer 5 has two seconds advance. The contact 7 consequently closes before the signal 8.2 is delivered. In this instance, the control circuit 9 produces the signal 9.8 which cuts off the sending of the driving pulses from the instant the contact 7 closes until the moment when the signal 8.2 is delivered by the counter-tracker 8. In this instance, since the test pulse has not been supplied, the signal 9.4 is not sent to the shaper 3 at the moment when the counter 8 delivers the signal 8.2; consequently, the driving pulses delivered by the shaper 3 after the cutting off of the signal 9.8 have the same duration as they had before the contact 7 closed.

It should be noted that this last instance ensures an automatic synchronization between the position of pointer 5 and the state of the counter-tracker 8. Consequently, it is not necessary to bring the pointer 5 to its position 0 on assembly of the watch or after a change of battery to guarantee this synchronism.

Figure 4:
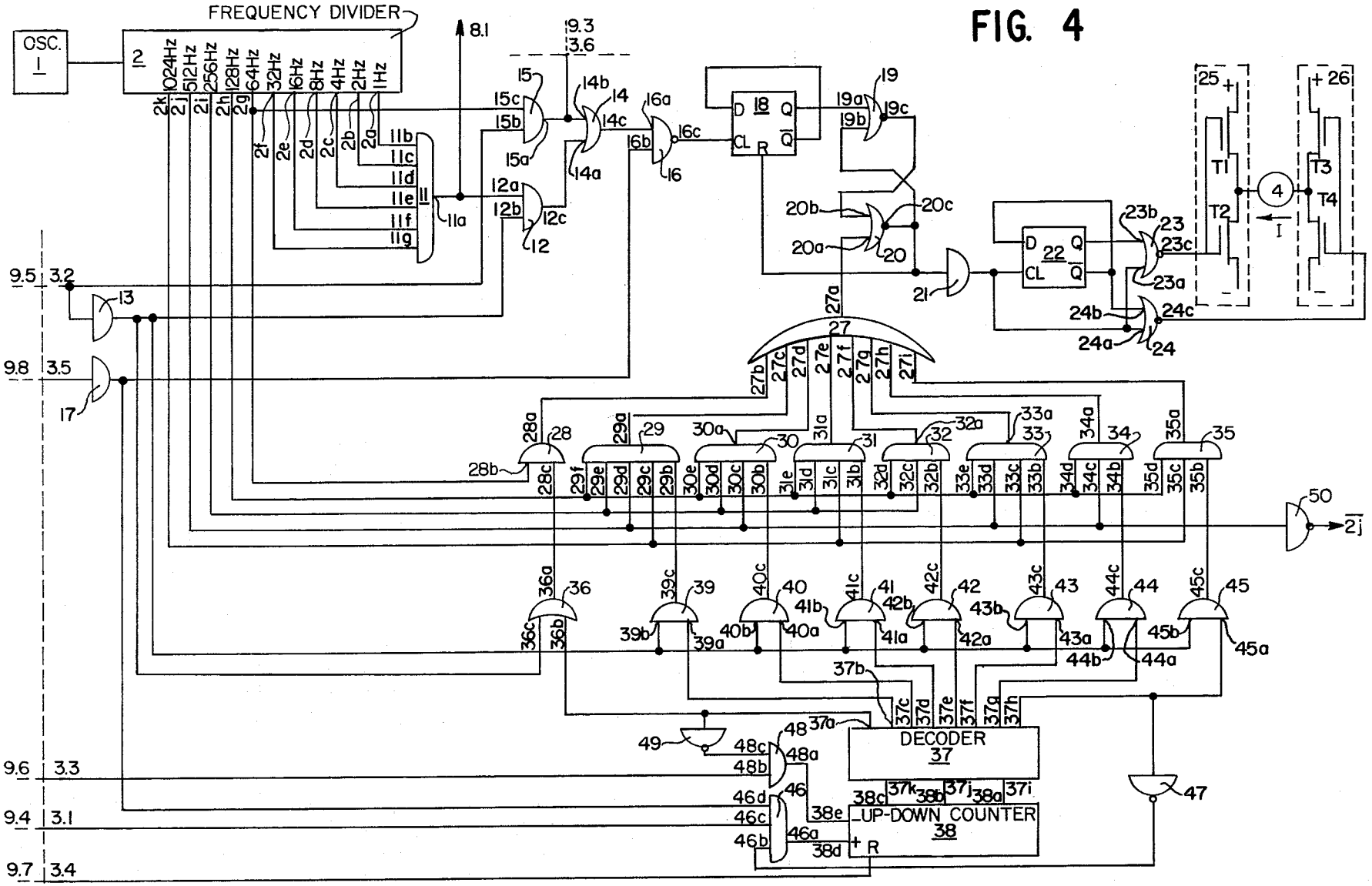
FIGS. 4 and 5 are more detailed diagrams of certain parts of the circuit of this first embodiment.
Figure 5:
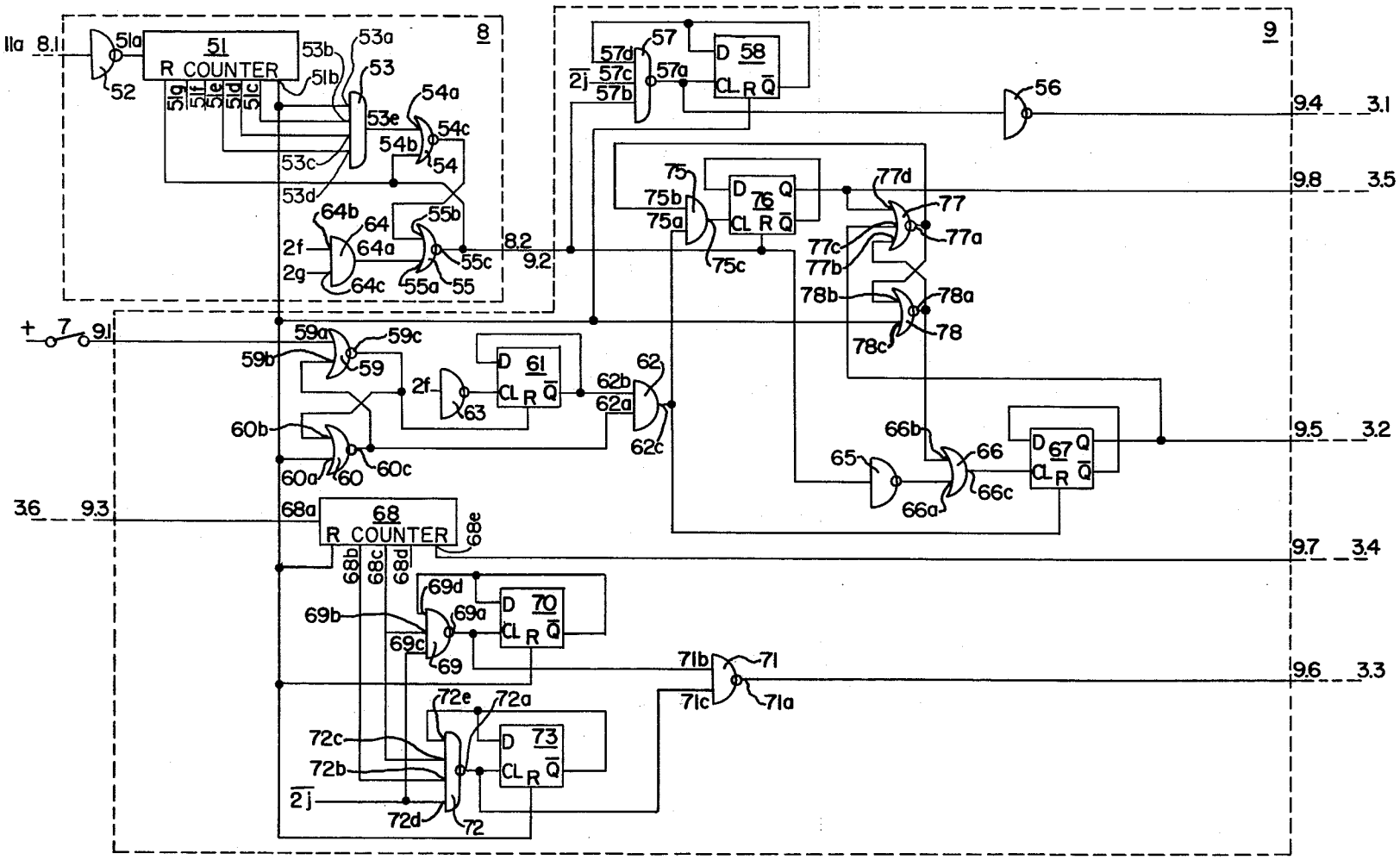

A more detailed diagram of an illustrative embodiment of the watch according to the invention is given in FIGS. 4 and 5. The functioning of these circuits will be described hereinafter, with the aid of the diagrams in FIGS. 6 to 8. These diagrams bear the references of the points in FIGS. 4 and 5 at which the signals they represent are measured.

It will be noted that the flip-flops included in these figures are all of type D and all have their output $\overline{Q}$ connected to their input D, with the result that they change state at each transition from "0" to "1" of their input CL ("clock"), if their reset input R is in logic state "0". A "1" state at this input R imposes a "0" state on their output Q and a "1" state on their output Q, irrespective of the state of their other inputs.

Furthermore, to shorten the description, each time this is possible, expressions of like "the output 36*a* of gate 36" or "the input 35*b* of gate 35" will be abbreviated to "the output 36*a*" or "the input 35*b*". Similarly, the word "flip-flop" will be abbreviated to "FF". Finally, the various signals which will be mentioned will be designated by the reference of the point at which they are measured, and the logic states 0 and 1 by "0" and "1".

FIG. 4 is a diagram of an embodiment of the shaper circuit 3, in which the oscillator 1 and the divider 2, as well as the motor 4, have also been represented.

To begin with, it will be assumed that the inputs 3.1 to 3.5 as well as the outputs Q of all the FFs are at "0".

The divider 2, which is conventionally formed by a series of FFs, not represented, connected in cascade, receives from the oscillator 1 a 32 khz signal and delivers to its outputs 2*a* to 2*k* signals with a frequency of 1, 2, 4, 8 to 1024 Hz respectively. The FFs of the divider 2, as is generally the case with this type of divider, are so arranged that each of these output signals changes state on the changeover from "1" to "0" of the signal of the previous stage.

Figure 6:
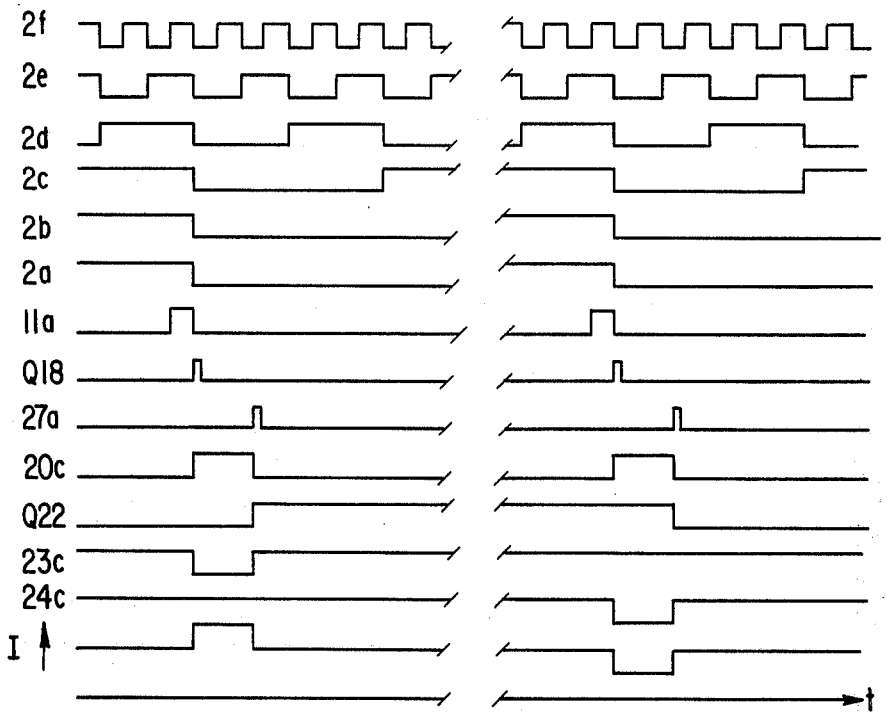

The output 11*a* of an AND gate 11, whose inputs 11*b* to 11*g* are connected to outputs 2*a* to 2*f* of the divider 2, delivers a signal with a period of 1 second and a duration of about 15.6 ms, just before the signal 2*a* changes again to "0" (FIG. 6).

An AND gate 12, whose input 12*a* is connected to the output 11*a*, transmits the signal 11*a* through its output 12*c* to the input 14*a* of an OR gate 14. Its input 12*b* is in fact connected, via an inverter 13, to the input 3.2 and consequently is at "1". The input 14*b* of this gate 14, which is connected to the output 15*a* of an AND gate 15, is at "0" because the input 15*b* of this gate 15 is connected to the input 3.2 of the shaper 3, which is at "0". This signal 11*a* is consequently found also at the output 14*c* and at the input 16*a* of a NAND gate 16 which is connected to it. As the input 16*b* of the latter is connected to the input 3.5 via an inverter 17, and consequently is at "1", the signal 11*a* is transmitted, inverted, to the input CL of a FF 18.

This FF consequently sets at the end of the signal 11*a* and its output Q changes to "1". This output is connected to the input 19*a* of a memory store 19–20 formed by the NOR gates 19 and 20 whose outputs 19*c* and 20*c* are connected, respectively, to inputs 20*b* and 19*b*. The output 20*c* consequently changes to "1", and as it is connected to the input R of the FF 18, the output Q of the latter immediately changes again to "0" (the duration of the state "1" of this output Q 18 is greatly exaggerated in FIG. 6; it is really only a few fractions of microsecond).

The signal 20*c* is transmitted, inverted by an inverter 21, to the input CL of an FF 22, which consequently does not set at this instant, and to inputs 23*a* and 24*a* of two NOR gates 23 and 24. The inputs 23*b* and 24*b* of the latter being connected, respectively, to the outputs Q and $\overline{Q}$ of the FF 22, the output 23*c* changes to "1" while the output 24*c* stays at "0".

The outputs 23*c* and 24*c* are respectively connected to two inverters 25 and 26, formed by transistors T1 to T4 dimensioned so as to be able to supply the necessary current for the motor 4 to work. If the outputs 23*c* and 24*c* are at "0", the transistors T1 and T3 are conducting and the transistors T2 and T4 are blocked; the motor is consequently practically short-circuited. When the output 23*c* changes to "1", the transistor T1 is blocked and the transistor T2 becomes conducting, and a current I begins to circulate in the direction indicated by the arrow, arbitrarily taken as positive. The motor consequently starts to run.

Some time after the start of this driving pulse, a signal "1", whose production will be explained below, appears at the output 27*a* of an OR gate 27 which is connected to the input 20*a* of the memory store 19–20. This signal 27*a* causes the resetting of the memory store 19–20 whose output 20*c* changes to "0" again. The transistor T2 consequently blocks, while the transistor T1 becomes conductive again and the driving pulse is cut off. Please note that the duration of this driving pulse is also exaggerated in FIG. 6.

Simultaneously, the input CL of the FF 22 changes to "1", which causes its setting and the changeover of its output Q to "1", and of its output Q to "0". The circuit stays in this state until the appearance of the next pulse 11*a*, a second later. The process described above begins again, excepting only that, this time, the output Q of the FF 22 is at "1", and its output Q at "0". The signal 20*c* is consequently transmitted to the output 24*c* and causes the blocking of the transistor T3 and the conduction of the transistor T4. A current is consequently established in the negative direction, the reverse of that of the arrow.

As above, the signal 27*a* causes the resetting of the memory store 19–20 and the end of the driving pulse. The process described above recurs each second, and the motor thus also receives each second alternating driving pulses whose start is fixed by the end of the pulse 11*a* and their end by the start of the signal 27*a*.

In the present instance, this signal 27*a* comes from the output 28*a* of an AND gate 28, which is connected to the input 27*b*. The other inputs 27*c* to 27*i* are all at "0", because they are connected to the outputs 29*a* to 35*a* of seven AND gates 29 to 35, which will be seen below to be at "0".

It will also be seen below that the input 28*c* of the gate 28 is in state "1"; consequently, the state of the output 28*a* varies like that of the input 28*b*. As the latter is connected to the output 2*g* of the divider 2, the output 28*a*, and consequently the output 27*a* and the input 20*a*, change from "0" to "1" about 7.8 ms (a half-period of the 64 Hz signal delivered by the output 2*g*) after the signal 11*a* has changed to "0". The driving pulse consequently lasts 7.8 ms.

The input 28*c* of the gate 29 is in state "1" because it is connected to the output 36*a* of an OR gate 36, itself having an input 36*b* connected to an output 37*a* of a decoder 37.

This decoder, entirely conventional, always has one and one only of its eight outputs 37*a* to 37*h* in state "1", depending on the state of its inputs 37*i* to 37*k*, which are respectively connected to the three outputs 38*a* to 38*c* of a reversible counter 38 which, for the moment, are in state "000". The output 37*a* of the decoder 37 is indeed that which is at "1" for this particular combination of inputs 37*i* to 37*k*.

The reversible counter 38, which is also of a well-known type, is provided with an incrementing input 38*d* and a decrementing input 38*e*, that is to say, each pulse delivered to its input 38*d*, in a way which will be described later, increases its content by one unit, while each pulse delivered to its input 38*e* decreases this content by one unit.

As described above, for each binary combination of states of the outputs 38*a*, 38*b* and 38*c*, taken in that order, one of the outputs 37*a* to 37*h* of the decoder 37 is in state "1", the others being at "0". A "1" on the output 37*a* corresponds to state "000", a "1" on the output 37*b* corresponds to state "001", and so forth until a "1" on the output 37*h* corresponds to state "111".

It has already been seen that the output 37*a* is connected to the input 28*c* of the gate 28 via the gate 36. The other outputs 37*b* to 37*i* of the decoder 37 are respectively connected to the inputs 39*a* to 45*a* of seven AND gates 39 to 45, with second inputs 39*b* to 45*b* connected together at the input 3.2 via the inverter 13. These inputs 39*b* to 45*b* are consequently at "1" for the moment, and the outputs 39*c* to 45*c* are in the same state as the outputs 37*b* to 37*i*, which are at "0".

The outputs 39*c* to 45*c* being respectively connected to the inputs 29*b* to 35*b*, and the other inputs 29*c* to 29*f*, 30*c* to 30*e*, 31*c* to 31*e*, 32*c* and 32*d*, 33*c* to 33*e*, 34*c* and 34*d*, and 35*c* and 35*d* being connected to the outputs 2*h* to 2*k* of the divider 2 as indicated in FIG. 4, it is clear (FIG. 7) that if, in any way which will be described later, the state of the outputs 38*a* to 38*c* changes as a consequence of the modification of the content of the counter 38, the signal 27*a* also changes, the instant when it changes to "1" for the first time after the changeover of the signal 11*a* from "1" to "0" being different for each combination of outputs 38*a* to 38*c*.

Thus, for example, when the outputs 38*a* to 38*c* are in state "001", the output 37*b*, the output 39*c* and the input 29*b* are at "1", and the output 29*a*, and consequently the output 27*a*, change to "1" as soon as the four outputs 2*h* to 2*k* of the divider 2 are simultaneously at "1", that is to say, about 7.3 ms after the changeover of the output 11*a* from "1" to "0".

Figure 7:
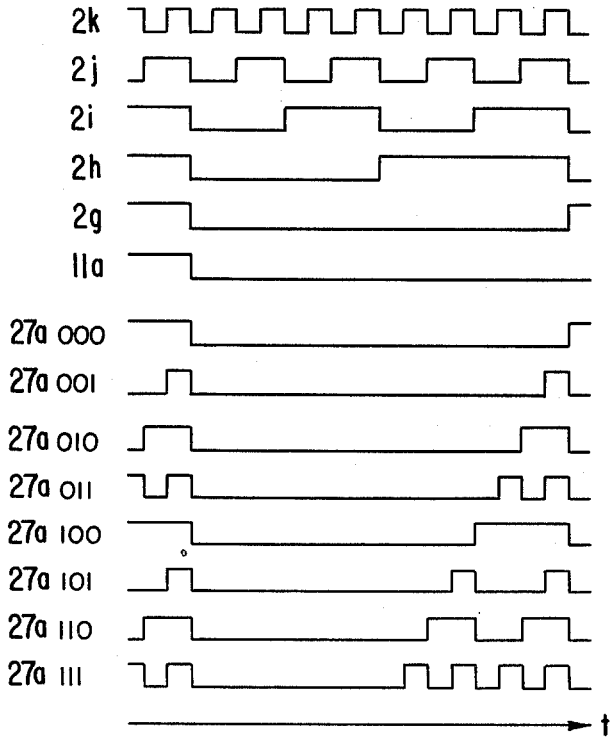

FIG. 7 shows the form of the signal 27*a* for each of the combinations of the states of the outputs 38*a* to 38*c*. In this figure, the references $27a_{000}$, $27a_{001}$, to $27a_{111}$ designate the diagrams of the signal 27*a* for the states "000", "001", to "111" of the outputs 38*a* to 38*c*. If it is recalled that the start of the driving pulses is determined by the changeover of the signal 11*a* from "1" to "0" and their end by the changeover of the signal 27*a* from "0" to "1", it is seen that the duration of these driving pulses depends directly on the content of the counter 38. When this content increases, the duration of the driving pulses decreases. In the example described, this duration changes from about 7.8 ms to about 4.4 ms by steps of about 0.5 ms (to be precise, from 8 to 4.5 periods of the 1024 Hz signal 2*k*, by steps of a half-period of the same signal) when the content of the counter 38 changes from 0 to 7 (from 000 to 111 in binary).

The circuits described above therefore constitute a means of regulating in steps the duration and consequently the energy of the driving pulses.

It is useful to note that the pulses appearing in certain instances after the first changeover of the signal 27*a* from "0" to "1" have no effect, because the memory store 19–20 changes state at this changeover and remains in its rest state until the end of the next pulse 11*a*.

The content of the counter 38 is increased by pulses applied in a way which will be described to its input 38*d* by the output 46*a* of an AND gate 46, one input 46*c* of which is connected to the input 3.1 of the shaper 3. When this content reaches its maximum value 7, (in binary 111), the output 37*h* of the decoder 37 assumes the state "1". This output 37*h* being connected, via an inverter 47, to an input 46*b* of the gate 46, the latter is then closed, and the subsequent pulses arriving at the input 3.1 no longer reach the input 38*d*. One thus avoids a new pulse on the input 3.1 making it change to "0" again when the content of the counter 38 is at 7, which would make the duration of the driving pulses change again from its minimum value to its maximum value.

Similarly, the content of the counter 38 is decreased by pulses applied in a way which will also be described later, to its input 38*e* via the output 48*a* of an AND gate 48, one input 48*b* of which is connected to the input 3.3 of the shaper 3. When the content of the counter 38 is at its minimum value 0, the output 37*a* of the decoder 37 is at "1", and as this output 37*a* is connected to the input 48*c* of the gate 48, via an inverter 49, this gate 48 is closed, and the pulses arriving at the input 3.3 no longer reach the input 38*e*. One thus avoids a new pulse on the input 3.3 making the counter 38 change again to its state 7, when the counter 38 is at 0.

FIG. 4 further shows an inverter 50 whose input is connected to the output 2*j* of the divider 2 and whose output consequently delivers a signal $\overline{2j}$ whose use will be described later.

FIG. 5 is a diagram of an embodiment of the counter-tracker 8 and of the control circuit 9, whose functioning will be described with the aid of the diagrams in FIG. 8.

As shown in FIG. 5, the counter-tracker 8 comprises a counter 51 which receives at its input 51*a*, via an inverter 52, the pulses delivered by the output 11*a* of the gate 11 (FIG. 4). The counter 51 comprises six FFs interconnected in a conventional way and can consequently count from 0 to 63 theoretically. But the outputs 51*b* to 51*e* of the last four FFs are connected to the inputs 53*a* to 53*d* of an AND gate 53, whose output 53*e* is connected to the input 54*a* of a memory store 54–55 formed by two NOR gates 54 and 55 whose outputs 54*c* and 55*c* are respectively connected to the inputs 55*b* and 54*b*. The output 55*c* is additionally connected to the reset input R of the counter 51 so that, when the logic states of the outputs 51*b* to 51*g*, taken in this order, form the binary combination "111100" corresponding, in decimal, to 60, the memory store 54–55 sets, and the signal "1" which appears at its output 55*c* returns the counter 51 to zero. Consequently the latter stays in its state 60 for only a very brief instant.

So the counter 51 counts the pulses delivered by the output 11*a* of the gate 11, which have a one second period, and the end of which causes the start of the driving pulses, as described above. This counter 51 is consequently entirely comparable to the seconds counter of a digital display watch. It is also a reference counter because the binary combination of states which these outputs 51*b* to 51*g* assume at the end of each pulse 11*a* (it reacts to the changeover of 11*a* from "1" to "0"), corresponds to the number of the graduation of the dial which the seconds pointer 5 has to reach, and generally does reach, under the action of the driving pulse which begins at this instant. The signal "1" appearing at the output 55*c* when it returns to "0" is a reference signal indicating that the pointer 5 should arrive at the graduation 0 of the dial.

The output 51*b*, additionally, assumes the state "1" from the moment when the counter reaches its state 32 (100000 in binary) until the moment when the counter 51 is reset to zero, as described above. This property is advantageously used, as will be seen later, for resetting to zero certain counters and FFs within the prescribed time.

When the counter 51 changes from its state 59 to its state 60, it has been seen above that the store 54–55 sets and causes the counter 51 to return immediately to its state 0. Simultaneously, the output 9.4 of the control circuit 9, which is connected, via an inverter 56 to the output 57*a* of a NAND gate 57, delivers a pulse of a duration of about one ms (a half-period of a 512 Hz signal). In fact, this gate 57 has an input 57*b* connected to the output 55*c*, an input 57*c* connected to the output of the inverter 50 (FIG. 4) and an input 57*d* connected to the output $\overline{Q}$ of a FF 58. At the moment when the output 55*c* changes to "1", the signal 2*j* is at "0" and the input 57*c* consequently at "1". The output 9.4 consequently changes to "1" and stays there until the input 57*c* changes to "0", that is to say, about one ms later. At this moment, the FF 58 sets and its output $\overline{Q}$ applies a signal "0" to the input 57*d*, thus preventing the formation of other pulses. This FF 58 remains in this state until the output 51*b* of the counter 51, which is connected to its input R, changes to "1", that is to say, for 32 seconds.

The pulse 9.4 is applied, via the input 3.1 of the shaper 3, to the input 38*d* of the counter 38 (FIG. 4). The content of this counter 38 is consequently increased by one unit. The driving pulse which begins at this instant, and which is the test pulse, will consequently have a duration reduced by one step (about 0.5 ms) in relation to the preceding pulses, provided, of course, that these preceding pulses have not already had the minimum duration.

If the resistance torque opposing the turning of the motor is less than the motor torque created by this test pulse, as is generally the case, the contact 7 closes some time after the start of this test pulse (FIG. 8*a*). The input 9.1, which is connected to the contact 7, consequently changes to "1" and a memory store 59–60 whose input 59*a* is connected to the input 9.1 sets. This memory store 59–60 is formed by two NOR gates 59 and 60 whose outputs 59*c* and 60*c* are connected to the inputs 60*b* and 59*b* respectively.

It can be noted here that the bouncing of the contact 7 has no influence on the circuit. The memory store 59–60 in fact sets at the first closing of the contact 7 and stays in that state until, 32 seconds later, the output 51*b* of the counter 51, which is connected to the input 60*a*, changes again to "1". It may also be noted that, at this moment, the contact 7 will certainly be open again, with the result that possible bouncing at the time of this opening will have no effect.

The setting of the store 59–60 puts at "0" the input R of a FF 61 which is connected to the output 59*c*, and puts at "1" the input 62*a* of an AND gate 62. The input 62*b* of this gate 62 is connected to the output $\overline{Q}$ of the FF 61, which is still at "1". The output 62*c* consequently changes to "1" at the moment the store 59–60 sets and stays there until the 32 Hz signal delivered by the output 2*f* of the divider 2 and applied, via a connection not represented, to the input of an inverter 63 whose output is connected to the input CL of the FF 61, changes to "0". This causes the changeover of the output $\overline{Q}$ of the FF 61 and consequently of the output 62*c* to "0".

The input 55*a* of the memory store 54–55 receives from the output 64*a* of an AND gate 64, whose inputs 64*b* and 64*c* are connected, by connections not represented, respectively to the outputs 2*f* and 2*g* of the divider 2, a signal which is at "1" when these two outputs 2*f* and 2*g* are simultaneously at "1". When this signal appears, 23.4 ms after the memory store 54–55 sets, the latter resets into its rest state, and the output 55*c* changes again to "0". As this output is connected, via an inverter 65, to the input 66*a* of an OR gate 66 whose output 66*c* is connected to the input CL of a FF 67, this input changes to "1". But as the contact 7 is closed before that instant, the signal 62*c*, applied to the input R of the FF 67, and which is still at "1", prevents the latter from setting. Its output Q, which constitutes the output 9.5 of the shaper 9, consequently stays at "0".

If, on the other hand, (FIG. 8*b*), the resistance torque is larger than the motor torque, or if the motor has not reacted to one or several of the preceding driving pulses, the contact 7 is not closed before the changeover of the output 55*c* to "0". The outputs 60*c* and 62*c* thus staying at "0", the FF 67 can set at the moment when the signal 55*c* changes again to "0", as its input R is at "0". The output 9.5 of the control circuit 9 consequently changes to "1" and applies a delay signal, via the input 3.2 of the shaper 3, to the input 15*b* of the gate 15 whose input 15*c* is connected to the output 2*g* of the divider 2 (FIG. 4). The output 15*a* consequently begins to deliver pulses at a frequency of 64 Hz, pulses which act on the FF 18 and on the circuits which follow it like the pulses 11*a* described above. The motor 4 consequently begins to receive compensation driving pulses at this same 64 Hz frequency.

Simultaneously, the signal present at the input 3.2, applied to the inputs 39*b* to 45*b* of the gates 39 to 45 via the inverter 13, closes the latter whose outputs are kept at "0"; the gate 36, on the other hand, has its output 36*a* at "1", as its input 36*c* is directly connected to the input 3.2. Consequently the duration of the compensation driving pulses is determined by the signal applied to the input 28*b* of the gate 28, irrespectively of the state of the counter 38. The compensation driving pulses consequently have the maximum duration. This state lasts until the contact 7 closes. At that moment, the memory store 59–60 sets, and the output 62*c* changes to "1", which rests the FF 67 to zero, and consequently the output 9.5.

The pulses delivered by the output 15*a* as long as this compensation process lasts, and whose number N corresponds to the number of compensation driving pulses which have been necessary for the motor to compensate for its delay and for the contact 7 to close, are counted by a counter 68 whose input 68*a* is connected, via the input 9.3 of the control circuit 9 and the output 3.6 of the shaper 3, to this output 15*a*. This counter 68 includes four FFs, connected in cascade in a conventional way, and whose outputs form the four outputs 68*b* to 68*e* of the counter 68.

In the example described, if the seconds pointer 5 has no delay before the test pulse, and if the latter has not advanced the motor, two compensation pulses will have to be sent to bring the pointer 5 to its position 0. The test driving pulse in fact has had a certain polarity and has not advanced the motor. The first compensation pulse consequently has reversed polarity from that of the test pulse, that is to say, the same polarity as that of the driving pulse which brought the motor to the state it is in. This first compensation pulse consequently has no effect on the motor, and it is the second compensation pulse, which, having the same polarity as the test pulse, actually brings the pointer 5 to its position 0. Consequently, the counter 68 in this case counts two pulses delivered by the output 15*a*.

The output 69*a* of a NAND gate 69, one input 69*b* of which is connected to the output 68*c*, consequently changes to "0" at that instant, because its two other inputs 69*c* and 69*d* are respectively connected to the output of the inverter 50 (FIG. 4) and to the output $\overline{Q}$ of a FF 70, which are both at "1". The output 9.6 which is connected to the output 71*a* of a NAND gate 71, one input 71*b* of which is connected to the output 69*a*, consequently changes to "1" and stays there until the signal 2*j* changes to "0". At that moment, the output 9.6 changes to "0" again. Simultaneously, the FF 70 whose input CL is connected to the output 69*a*, sets and its output $\overline{Q}$ changes to "0" which closes the gate 69 and prevents the subsequent pulses delivered by the output 2*j* of the divider 2 from reaching the output 9.6.

The pulse thus formed is applied to the input 38*e* of the counter 38 via the input 3.3 of the shaper 3 and the gate 48 (FIG. 4). It decreases the content of this counter by one unit, and consequently increases by one step the duration of the next driving pulses. As this duration has been reduced by one step for the test pulse, these next driving pulses will have the same duration as those which preceded the test pulse (see FIG. 3*b*).

If, on the other hand, the seconds pointer 5 has already been delayed before the test pulse, the shaper must send more than two compensation pulses to the motor 4. On the second compensation pulse, the output 9.6 delivers a first pulse like that described above; on the third of these compensation pulses, the outputs 68*b* and 68*c* change to "1". The output 72*a* of a NOT-AND gate 72, whose inputs 72*b* and 72*c* are connected to these two outputs 68*b* and 68*c*, changes to "0".

As the output 72*a* is connected to the second input 71*c* of the gate 71, the output 71*a* of the latter, and consequently the output 9.6, changes to "1" again until the input 72*d* of the gate 72, which is also connected to the output of the inverter 50, changes to "0". At that instant, a FF 73 whose input CL is connected to the output 72*a* sets and the signal "0" which appears at its output $\overline{Q}$ closes the gate 72 via its input 72*e*. This second pulse further decreases the content of the counter 38 by one unit. The subsequent driving pulse will consequently have a duration increased by one step in relation to the driving pulses which preceded the test pulse (see FIG. 3*c*).

If the seconds pointer 5 has eight seconds delay or more, the output 68*e* of the counter 68 changes to "1" when the eighth compensation pulse is sent to the motor 4 by the shaper 3. In this case, the output 9.7 of the control circuit 9, which is connected to this output 68*e*, changes to "1", which causes the resetting to zero of the counter 38 whose input R is connected to the input 3.4, itself connected to the input 9.7. Consequently, if eight or more compensation pulses have had to be sent to the motor before the contact 7 closes, which means that the seconds pointer 5 had eight or more delay steps, the subsequent driving pulses will have the maximum duration (see FIG. 3*d*).

It is consequently clear that the circuits 69 to 73 allow a decision to be taken with regard to the duration, and consequently the energy, of the driving pulses following the test pulse.

When the contact 7 closes before the signal 55*c* changes to "1", that is to say, the seconds pointer 5 has become advanced (see FIG. 3*e*), the signal 62*c* changes to "1" as described above. This signal is applied to the input 75*a* of an AND gate 75, whose output 75*c* is connected to the input CL of a FF 76. As the input R of the FF 76 is connected to the output 55*c* and consequently is at "0", this FF 76 sets, and its output Q, which is connected to the output 9.8 of the control circuit 9, changes to "1".

The input 16*d* of the gate 16 (FIG. 4), which is connected to the input 3.5, and consequently to the output 9.8, through the inverter 17, consequently changes to "0", which, from that instant, prevents the pulses delivered by the output 11*a* of the gate 11 from reaching the input CL of the FF 18. The motor consequently receives no more driving pulses and stops, until the output 55*c* changes to "1", which resets the output Q of the FF 76 to "0" and consequently the input 16*b* of the gate 16 to "1".

The circuit formed by the gates and FFs 65 to 67 and 75 and 76 consequently forms a circuit for comparing the reference signal 8.2 and the signal coming from the contact 7.

A memory store 77–78, formed by two NOR gates 77 and 78 whose outputs 77*a* and 78*a* are respectively connected to the inputs 78*b* and 77*b*, has two inputs 77*c* and 77*d* respectively connected to the outputs Q of the FFs 67 and 76. In this way, when one of these FFs sets, the memory store 77–78 also sets. As the outputs 77*a* and 78*a* are respectively connected to the inputs 75*b* and 66*b*, setting of the FF 76 at the end of the compensation process, which would cause the motor to stop completely, is thus avoided. Conversely, setting of the FF 67, at the end of the driving pulses being blocked by the signal 9.8, which could cause the formation of unnecessary compensation pulses, is also avoided.

The resetting of zero of the memory store 59–60 at the moment when the state of the counter 51 arrives at 32 has already been described above. At the same time as this, the memory store 77–78, the counter 68 and the FFs 58, 70 and 73 are reset to zero, if, of course, they have left this state. Their reset inputs, 78*c* for the memory store 77–78, and R for the counter 68 and the FFs 58, 70 and 73, are also in fact connected to the output 51*b* of the counter 51. The circuit is then ready to begin functioning again when the signal 53*e* is delivered again.

Clearly, it is possible to provide other modes of functioning for achieving the object required. FIG. 9, in which, as in FIGS. 3*a* to 3*e*, the driving pulses are represented by vertical segments whose length is proportional to the duration of the pulses, illustrates the functioning of a second illustrative embodiment of the watch according to the invention, in which the test pulses have a duration two steps shorter than the pulses which precede them. If the motor reacts to these test pulses (FIG. 9*a*), the duration of the subsequent pulses is increased by one step in relation to the duration of the test pulse.

If the contact 7 is not closed in the required time, the shaper circuit, as in the first embodiment described above, delivers compensation pulses. When the contact 7 is closed, after two compensation pulses (FIG. 9*b*), the subsequent driving pulses have the same duration as those preceding the test pulse.

When the contact 7 closes after more than two and less than eight compensation pulses (FIG. 9*c*), the subsequent driving pulses have a duration greater by one step than that of the preceding driving pulses, and when eight or more compensation pulses have to be delivered by the shaper 3 before the contact 7 closes (FIG. 9*d*), the duration of the subsequent driving pulses is equal to the maximum duration.

It will be noted that the time scale is twice as great in FIG. 9*d* as in FIGS. 9*a* to 9*c*. In addition, the space separating the compensation pulses is exaggerated to facilitate reading of the figures.

In this second illustrative embodiment, the reliability of the watch's functioning is considerably improved without energy consumption being substantially increased.

Figure 10:
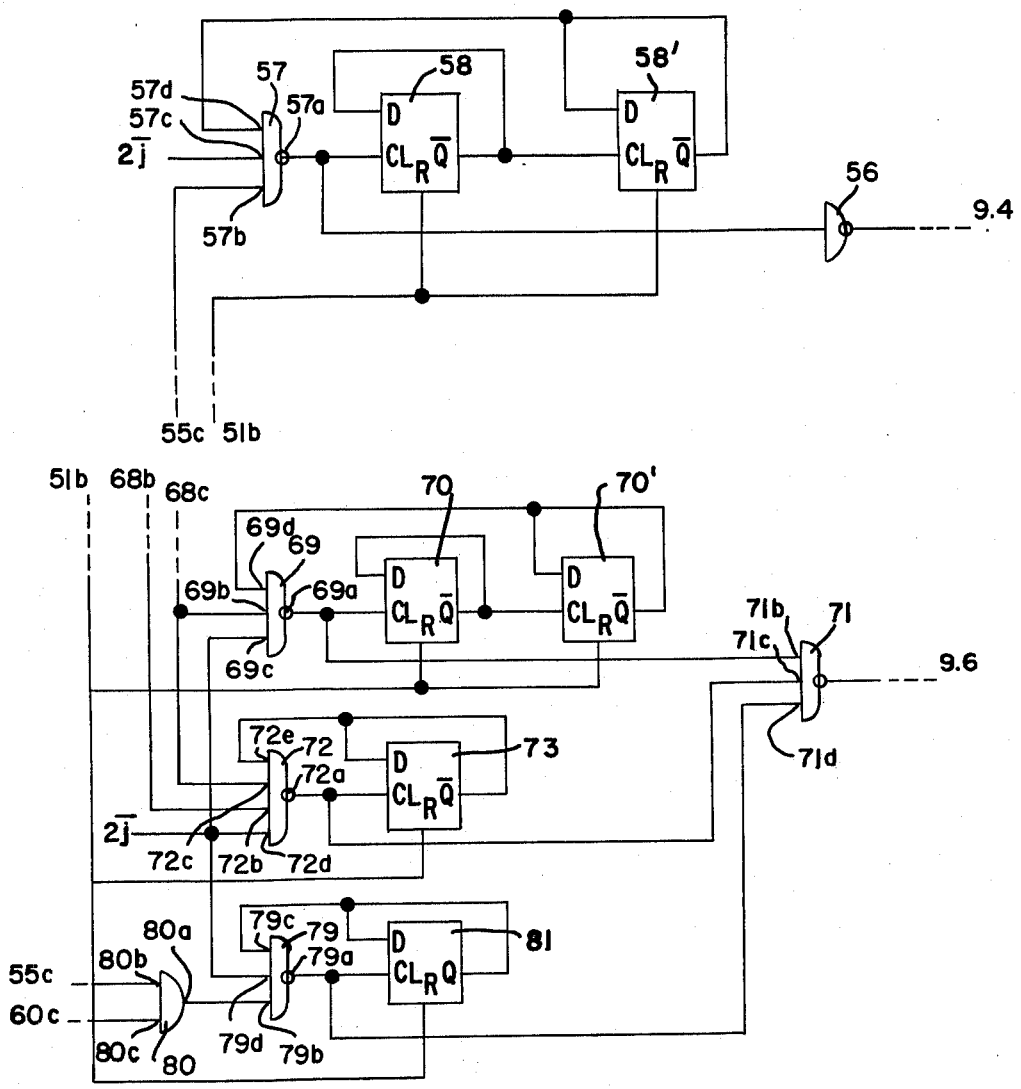
FIG. 10 is a partial diagram of the circuit of this second embodiment.

FIG. 10 shows the small number of modifications which have to be made to the diagram in FIG. 5 in order to adapt it to this second embodiment.

The circuit formed by the inverter 56, the gate 57 and the FF 58, a circuit which delivers a signal to the output 9.4 to increment the counter 38 (FIG. 4) when the store 54–55 sets, recurs in this FIG. 10. However, the output $\overline{Q}$ of the FF 58 is no longer connected to the input 57*d* of the gate 57, but to the input CL of a FF 58′ whose output $\overline{Q}$ is connected to this input 57*d*. In this way, when the signal 55*c* changes to "1", not one but two pulses are delivered by the output 9.4. In fact, on the first pulse, the output $\overline{Q}$ of the FF 58 changes to "0", and on the second, it changes to "1" again, which sets the FF 58′ and changes its output $\overline{Q}$ to "0", and closes the gate 57.

These two pulses increase the content of the counter 38 by two units and consequently decrease by two steps the duration of the driving pulses, which are test pulses, starting at that instant.

The circuit formed by the gates 69, 71 and 72 and by the FFs 70 and 73, this circuit delivering, as described above, pulses to the output 9.6, also recurs in this FIG. 10. But here also, a FF 70' has been added to the circuit, with its input CL connected to the output $\overline{Q}$ of the FF 70 and its output $\overline{Q}$ connected to the input 69*d*, so that two pulses instead of only one are now delivered to the output 9.6 when the content of the counter 68 arrives at two, that is to say, at the second compensation pulse.

Finally, the gate 71 is provided with a third input 71*d*, which is connected to the output 79*a* of a NAND gate 79. As this gate 79 is provided with an input 79*b* connected to the output 80*a* of an AND gate 80 whose inputs 80*b* and 80*c* are themselves connected to the outputs 55*c* and 60*c*, with an input 79*d* connected to the output of the inverter 50 (FIG. 4) and with an input 79*d* connected to the output $\overline{Q}$ of a FF 81 whose input CL is connected to the output 79*a*, the output 9.6 delivers a pulse when the contact 7 is closed in the required time, that is to say, while the output 55*c* is at "1". This pulse is the one which decreases the content of the counter 38 by one unit and consequently increases the duration of the next driving pulses, as described above.

When the driving pulses have their maximum duration for several consecutive minutes, this means that the voltage of the battery has decreased and that the latter will soon be dead, or that the mechanism of the watch is clogged and offers an over large resistance torque to the motor. In both instances, the user will want to take his watch to a watchmaker to have it cleaned or change its battery. FIG. 11 gives a diagrammatic example of an illustrative indicator.

In the circuit in FIG. 11, a counter 82 formed, for example, of four FFs, counts the pulses delivered to its input 82*a* by the output 83*a* of an AND gate 83 whose inputs 83*b* and 83*c* are respectively connected to the output 51*b* of the counter 51 (FIG. 5) and to the output 37*a* of the decoder 37 (FIG. 4). This output 83*a* consequently delivers one pulse each minute, when the counter 51 reaches its state 32 (in decimal) and the output 37*a* is at "1", that is to say, the driving pulses have their maximum duration. When the FFs composing the counter 82 reach their state "1111", that is to say, when the driving pulses have had their maximum duration for 16 consecutive minutes, the output 84*a* of an AND gate 84, whose inputs 84*b* to 84*e* are connected to the outputs 82*b* to 82*e*, changes to "1", which switches a display device 85 on.

This device can be constituted, for example, by a liquid-crystal or electro-chromic passive display element, or an active display element, such as a light-emitting diode. It can also be constituted by a circuit acting on the driving pulse shaper to modify the rate of advance of the pointer 5. All these devices are known, and will not be described in further detail here.

When the output 84*a* changes to "1", the input 83*d* of the gate 83, which is connected to this output 84*a* by an inverter 86, changes to "0", which holds the counter 82 in its state "1111".

When the duration of the driving pulses decreases, the counter 82 is reset to zero by a signal applied to its input R by the output 87*a* of an AND gate 87 whose input 87*b* is connected to the output 51*b* and whose input 87*c* is connected, via an inverter 88, to the output 37*a*.

The circuit formed by the gates, inverters, counter and decoder 27 to 49 (FIG. 4) is intended to determine the duration of the driving pulses as a function of the contents of the counter 38. FIG. 12 gives the diagram of a circuit which serves the same function, but which is far simpler. The counter 38, and the gates 46 and 48 which transmit to it the pulses delivered by the outputs 9.4 and 9.6 of the circuit 9 recur in FIG. 12. But the output 46*a* is now connected to the decrementing input 38*e* and the output 48*a* to the incrementing input 38*d*, which means on the one hand that each pulse delivered by the output 9.6 of the circuit 9 to extend the duration of the driving pulses increases the content of the counter 38 by one unit, provided that the gate 48 is not closed, and, on the other hand, that each pulse delivered by the output 9.4 of the circuit 9 to shorten the duration of the driving pulse decreases the content of the counter 38 by one unit, provided that the gate 46 is not closed.

The input 20*a* of the memory store 19–20 (FIG. 4) is, in the instance in FIG. 12, connected to the output 90*a* of an OR gate 90 whose input 90*b* is connected to the output 89*a* of an AND gate 89 and the input 90*c* to the output 2*g* of the divider 2. The input 89*b* of this gate 89 is connected to the output of the inverter 13 and is consequently normally at "1". Its inputs 89*d* to 89*g* are connected to the outputs 91*a* to 94*a* of four OR gates 91 to 94. The latter each have an input 91*b* to 94*b* respectively connected to one of the outputs 2*h* to 2*k* of the divider 2. The input 89*c* of the gate 89 is connected to the output 95*a* of a NAND gate 95 whose inputs 95*b* to 95*d* are connected to the outputs 38*f* to 38*h* of the counter 38. These outputs 38*f* to 38*h* are the complements of the outputs 38*a* to 38*c*, respectively, used in the diagram in FIG. 8. The second input 91*c* of the gate 91 is connected to the output 95*a* via an inverter 96, and the second inputs 92*c* to 94*c* are respectively connected to the outputs 38*f* to 38*h*.

When the counter 38 is in its state 0, the outputs 38*f* to 38*h* are in the state "111". The counter 38 can no longer be incremented by pulses delivered to the input 3.3 of circuit 3 by the output 9.6 of circuit 9, because the gate 48 is closed by the signal "0" applied by the output 95*a* to its input 48*c*.

This state "0" also closes the gate 89 through its input 89*c*, and the output 90*a* follows the signal 2*g*. The signal 88*a* consequently has the same form as the signal $27a_{000}$ in FIG. 7, and the driving pulses have their maximum duration.

The first pulse delivered by the output 9.4 to the input 3.1 and, through the gate 46, to the decrementing input 38*e*, changes the counter 38 from its 0 state to its 7 state. In this state, the outputs 38*f* to 38*h* assume the state "000" and the output 95*a* changes to "1". Conversely, the inputs 91*c* to 94*c* change to "0", with the result that the output 89*a*, and consequently the output 90*a*, delivers a signal "1" when the outputs 2*h* to 2*k* are simultaneously at "1". This is exactly the situation of the signal $27a_{001}$ in FIG. 7.

The subsequent pulses 9.4 change the outputs 38*f* to 38*h* to the state "001", then "010 . . . 110". For each of these states, a particular combination of signals 2*g* to 2*k* reach the output 90*a*, whose state varies in exactly the same way as in the diagrams $27a_{010}$ to $27a_{111}$ in FIG. 7.

A NAND gate 97 has its output 97*a* connected to the input 46*b* of the gate 46, its inputs 97*b* and and 97*c* connected to the outputs 38*f* and 38*g*, and its input 97*d* connected, through an inverter 98, to the output 38*h*. When the outputs 38*f* to 38*h* reach the state "110" corresponding to the minimum duration of the driving pulses (the counter 38 is then in its state 1, in decimal), the output 97*a* of the gate 97 consequently changes to "0" and closes the gate 46. The subsequent pulses delivered by the output 9.4 can consequently no longer reach the input 38*e*. Consequently, the counter 38 cannot change from this 1 state to its 0 state which, as seen above, corresponds to the maximum duration of the driving pulses.

Of course, the pulses delivered by the output 9.6 of the circuit 9, and which reach the input 38*d* via the gate 48, modify the state of the counter 38 in the opposite direction to that described above. The pulses 9.4 and 9.6 consequently have the same effect on the duration of the driving pulses as in the instance in FIG. 8.

Similarly, when the signal 9.5 changes to "1" to cause the formation of compensation pulses, the input 89*b*, which is connected to the output of the inverter 13, changes to "0". The gate 89 is consequently closed, and the signal 90*a* becomes identical to the signal 2*g*, which is applied to the input 90*c* of the gate 90. The driving pulses consequently have their maximum duration, irrespective of the state of the counter 38.

Finally, as in the instance in FIG. 4, when the signal 9.7 is applied to the reset input R of the counter 38, the duration of the driving pulses changes again to its maximum.

When a watch with the circuit described above is subjected to external influences such that the resisting couple is greater than the maximum motor torque, it is clear that the compensating pulses will not be able to drive the motor and that the contact 7 will never close. There is then the risk that the compensating pulses will be produced continuously until the battery has run down.

In order to eliminate this risk, the counter 68 counting the compensating pulses can be modified to give it a capacity for counting sixty pulses, for example, and to connect it to the FF 67 to reset the latter to its rest state when this number of pulses is attained. If then the contact 7 has not been closed again after the sixty compensating pulses have been applied to the motor, the signal 9.5 returns to "0" which interrupts the generation of these pulses. When the output 51*b* of the seconds counter 51, which continues to count normally, passes to "1", the counter 68 is reset to zero as above.

When the counter 51 returns to zero and the pulse 55*c* is generated, all as above-described, the FF 67 sets again, the signal 9.5 reverts to "1" and the compensating pulses are again applied to the motor. If the resisting couple is still greater than the maximum motor torque, the FF 67 is reset again after sixty compensating pulses, and so on.

The signal 9.5 which, under these conditions, alternates between "1" and "0" with a period of one minute, can be applied to a supplementary counter with a capacity of ten, for example. If the resisting couple becomes less than the motor torque again before the supplementary counter has counted ten pulses of the signal 9.5, the supplementary counter can be used, in conjunction with an auxiliary circuit which will not be described, to establish automatic making up of the time lost during the blocking of the motor, thereby putting the watch into the condition where it shows the exact time.

If, on the contrary, the contents of the supplementary counter reach the maximum value, a signal can be generated by the counter to block definitely the emission of the compensating pulses and to actuate an indicator signalling to the user that his watch is no longer functioning. If the cause of the stoppage is then removed, the watch should be reset to the correct time by the means provided for this operation, which can be arranged so as to reset the supplementary counter to zero.

Of course, other ways of implementing the invention could be provided by those skilled in the art. It would be possible, for example, to deliver a test pulse two or three timer per revolution of the seconds pointer; or to modify the number and size of the steps between the maximum duration and the minimum duration of the driving pulses; or again to choose the duration of the test pulses differently, and to modify the duration of the subsequent driving pulses in a different way according to the number of compensation pulses which have possibly had to be delivered.

Other parameters of the driving pulses could be varied to regulate the energy delivered to the motor. Each driving pulse could, for example, be replaced by a train of short pulses. As the inductance of the motor acts as a filter on this train of pulses, the effect of the latter will be the same as that of a driving pulse whose amplitude will be reduced by a factor equal to the mark/space ratio of the pulses forming the train. By varying this mark/space ratio, the amplitude of the resulting driving pulse, and consequently the energy supplied to the motor, could be varied.

While the invention has been illustrated and described as comprising one or more preferred embodiments, it is not intended to be limited to the details shown, since various modifications and changes may be made by those skilled in the art without departing from the spirit of the invention as disclosed and claimed herein.

What is claimed is:

1. A method for reducing the consumption of electrical energy in an electronic time piece wherein a motor is supplied by electrical energy for driving a time data displaying means in accordance with a time data signal, comprising the steps of:

periodically providing a reference signal in response to said data signal;

reducing said energy in response to said reference signal;

detecting a possible error in position of said displaying means on the basis of said time data signal;

correcting said possible error; and subsequently adjusting said energy in dependance of said detecting.

2. The method of claim 1, wherein:

said possible error detecting step comprises the step of providing a first error signal if the actual position of said displaying means differs from a reference position corresponding to the position which said displaying means should occupy immediately after the occurrence of said reference signal, and the step of providing a second error signal if said displaying means reaches said reference position prior to the occurrence of said reference signal; and said possible error correcting step comprises the step of accelerating said motor in response to said first error signal until said displaying means reaches said reference position, and the step of stopping said motor in response to said second error signal until the occurrence of said reference signal.

3. The method of claim 2, applicable to a time piece in which said motor is a stepping motor supplied by low frequency driving pulses the energy of which is adjustable by steps between a maximum and a minimum energy, wherein, said accelerating step comprises the supplying of said motor with high frequency compensation pulses having said maximum energy, and said stopping step comprises the inhibiting of said driving pulses.

4. The method of claim 3, wherein said reducing step comprises the reducing of said energy by one step, and said adjustment step comprises the increasing of said energy by one step if the number of said compensation pulses is smaller than or equal to a predetermined number and the increasing of said energy up to said maximum energy if said number of said compensation pulses is higher than said predetermined number.

5. The method of claim 3, wherein said reducing step comprises the reducing of said energy by two steps, and said adjustment step comprises the increasing of said energy by one step if none of said error signals is provided, the increasing of said energy by two steps if the number of said compensation pulses is smaller than or equal to a predetermined number, and the increasing of said energy up to said maximum energy if said number of said compensation pulses is greater than said predetermined number.

6. An electronic time piece comprising:

means for providing a time data signal;

means responsive to said time data signal for producing driving pulses;

means responsive to said driving pulses for displaying time data;

means responsive to said time data signal for producing a reference signal;

means responsive to said reference signal for causing the driving pulses producing means to reduce the energy of said driving pulses;

means coupled to the time data displaying means and responsive to said reference signal for detecting a possible error in position of said displaying means;

means for causing the driving pulses producing means to correct said possible error; and means for causing the driving pulses producing means to subsequently adjust the energy of said driving pulses in dependance of said possible error.

7. The time piece of claim 6, in which said detecting means comprises means for providing a first error signal if the actual position of said displaying means differs from a reference position corresponding to the position which said displaying means should occupy immediately after the occurrence of said reference signal, and means for providing a second error signal if said displaying means reaches said reference position prior to the occurrence of said reference signal; and the driving pulses producing means comprises means for adjusting said energy by steps between a maximum and a minimum energy, means for selecting the frequency of said driving pulses between a low and a high frequency and means responsive to said second error signal for inhibiting said driving pulses, wherein said adjusting means and said selecting means are responsive to said first error signal for causing the driving pulses producing means to produce high frequency driving pulses having said maximum energy until said displaying means reaches said reference position.

8. The electronic time piece of claim 7, wherein said adjusting means comprises means for counting said high frequency driving pulses, and said adjusting means is responsive to said reference signal for reducing said energy by one step and to said first error signal for increasing said energy by one step if the number of said high frequency driving pulses is smaller than or equal to a predetermined number and up to said maximum energy if said number of high frequency driving pulses is greater than said predetermined number.

9. The electronic time piece of claim 7, wherein said adjusting means comprises means for counting said high frequency driving pulses, and said adjusting means is responsive to said reference signal for reducing said energy by two steps, to the absence of said first error signal for increasing said energy by one step, and to said first error signal for increasing said energy by two steps if the number of said high frequency driving pulses is smaller than or equal to a predetermined number and up to said maximum energy if said number of high frequency driving pulses is higher than said predetermined number.

10. The electronic time piece of claim 7, further comprising means coupled to said adjusting means and responsive to said time data signal for displaying an alarm if said driving pulses have said maximum energy for a time period longer than a predetermined period.

* * * * *